United States Patent [19]

Chen

[11] 4,187,450

[45] Feb. 5, 1980

[54] HIGH FREQUENCY BALLAST TRANSFORMER

[75] Inventor: DeYu Chen, Scotia, N.Y.

[73] Assignee: General Electric Company, Schenectady, N.Y.

[21] Appl. No.: 884,767

[22] Filed: Mar. 9, 1978

[51] Int. Cl.[2] ..... H05B 41/26

[52] U.S. Cl. ..... 315/278; 315/219; 315/282; 336/165

[58] Field of Search ..... 315/209 R, 219, 224, 315/276, 278, 282, DIG. 5, DIG. 7; 331/113 R, 112; 336/160, 165

[56] References Cited

U.S. PATENT DOCUMENTS

| | | | |
|---|---|---|---|
| 2,949,565 | 8/1960 | Rohloff et al. | 315/DIG. 7 |
| 3,005,130 | 10/1961 | Schwartz | 315/206 |
| 3,078,429 | 2/1963 | Wiesner | 336/83 |
| 3,703,677 | 11/1972 | Farrow | 336/165 X |
| 3,781,638 | 12/1973 | Anderson et al. | 331/113 A X |
| 3,949,268 | 4/1976 | Von Mangoldt | 315/DIG. 5 |
| 3,956,684 | 5/1976 | Walden | 321/12 |
| 3,983,449 | 9/1976 | Dear et al. | 315/DIG. 5 |
| 4,080,725 | 3/1978 | Cronk | 336/165 X |
| 4,088,942 | 5/1978 | Miko | 336/165 X |

*Primary Examiner*—Eugene R. LaRoche

*Attorney, Agent, or Firm*—Geoffrey H. Krauss; Joseph T. Cohen; Marvin Snyder

[57] ABSTRACT

A transformer particularly useful in conjunction with solid state high frequency push-pull inverter supplies for discharge lamps is disclosed. In accordance with one embodiment of the present invention, two E-shaped core sections are disposed adjacent to one another in a mirror image fashion with corresponding core legs aligned but with an air gap provided between the middle legs of the core structure. The transformer disclosed permits the use of non-bifilar winding methods in the manufacture of transformers particularly useful in square-wave push-pull inverters used in discharge lamp ballasting circuits. In addition, the core structure disclosed provides for an integral ballasting reactance which minimizes power loss induced in the surrounding metal casing or other nearby metal structures.

9 Claims, 6 Drawing Figures

HIGH FREQUENCY BALLAST TRANSFORMER

BACKGROUND OF THE INVENTION

This invention relates to transformers of the type particularly useful in supplying power to a discharge lamp from a high frequency push-pull inverter power supply. In particular, this invention relates to transformer structures providing integral ballasting reactance and to a winding method which yields coupling close to that provided by bifilar winding but is more readily manufactured and which reduces interturn voltage differences.

The so-called push-pull square-wave inverter power supply for providing alternating current energy to an electric discharge lamp is an energy efficient circuit but one that requires transformer coupling to the discharge tube. In particular, the primary of the transformer comprises two portions which must be intimately coupled with one another. The two portions of the primary winding are typically serially connected forming a standard center-tapped primary winding, each winding being driven in an alternating fashion by the power output transistors in the push-pull inverter. In prior art transformers operating in conjunction with push-pull inverters, the portions of the primary winding must be bifilarly wound. However, the bifilar winding process is difficult, time-consuming, and expensive, especially as compared with more standard winding processes.

Moreover, in lamp discharge circuits, it is also necessary to provide a ballasting reactance to compensate for the fact that an initial high voltage is needed to initiate the discharge but a much smaller voltage is needed to sustain the discharge after ignition. This ballasting reactance is provided by a variety of prior art structures. For example, if a lumped (that is, multi-layered) primary and a lumped secondary winding are employed encircling a transformer core structure, then there is typically a certain portion of magnetic flux returned through the atmosphere rather than through the core, and the necessary ballasting reactance is provided by this leakage reactance due to imperfect primary and secondary coupling. The amount of ballasting leakage reactance is controlled by selectively adjusting the relative positions of two lumped primary and secondary windings. However, in prior art lumped winding structures, the primary center-tapped winding must be wound in a bifilar fashion to achieve the requisite degree of close coupling between the two primary portions.

Another method for providing the necessary ballasting reactance is by providing a second and separate ballasting inductor; but this configuration also needs bifilarly wound primary windings. However, this method consumes a greater amount of material and in addition takes up space especially in those discharge lamp applications in which the lamp, the ballast, and power supply are provided in an integrated structure.

For the case that a separate ballasting inductance is not provided, the requirement of a relatively large ballasting reactance implies that a large number of turns are needed with the primary circuit being wound as a lumped coil. This requirement for a large number of turns and the lumped coil also renders unpractical certain other primary winding methods which would otherwise be usable. In particular, one method of achieving close coupling between the two portions of the primary winding is to have one winding overlay the other rather than have the interleaved, but preferred, bifilar pattern. However, if the number of turns is required to be large in order to provide a large ballasting reactance, then an overlaid winding pattern becomes costly because of the number of layers required.

Thus, prior art transformers, particularly those used with high frequency inverters providing power to discharge lamps, are unable to supply sufficient ballasting reactance while at the same time permitting simple primary winding methods. In addition, prior art transformers in discharge lamp circuits suffer from an undesirable amount of energy loss due to leakage magnetic fields inducing currents in surrounding metal structures such as the ballast case.

SUMMARY OF THE INVENTION

In accordance with a preferred embodiment of the invention herein, a transformer core is provided with an integral magnetic shunt to provide the necessary ballasting reactance while minimizing the turns requirement. In accordance with a preferred embodiment of the invention herein, a transformer core comprising two E-shaped core members is disclosed. Each of these E-shaped core members possess outer (top and bottom) legs and a shorter middle leg. The two transformer core sections are disposed adjacent to one another with their outer and middle legs aligned in a mirror image fashion. The relative lengths of the middle core legs as compared with the lengths of the outer core legs result in a centrally located air gap which provides the necessary magnetic shunt and ballasting reactance in a transformer which is highly suited for operation of a discharge lamp powered by a high frequency push-pull inverter. The distance across the air gap determines the amount of reactance. Thus, the transformer core structure resembles an outer magnetic loop with a centrally located magnetic flux bypass (shunt) across the air gap.

The centrally located magnetic shut not only provides sufficient ballasting reactance but also enables the transformer windings to be formed from a significantly fewer number of turns while still providing the same amount of ballasting reactance. Since the magnetic shunt provides the ballasting reactance, there is no need for a primary and secondary winding with a large number of turns since the magnetic shunt provides the necessary leakage inductance. Consequently, the transformer structure disclosed herein permits a simple, two-layer overlaid, non-bifilar primary winding thus rendering transformers based on this core design to be made quickly, inexpensively and in large quantities. A significant portion of the savings that result from the transformer design disclosed herein are directly attributable to the fact that fewer conductive windings and less insulation is required than in prior art transformers. Moreover, the central location of the integral ballasting reactance and the narrowly confined flux air path provide for a small area of straying magnetic flux located relatively distant from any surrounding metal structures, thereby reducing inductive power consumption in these structures.

General background material on ballasting and inverters for discharge lamps may be found for example in the following U.S. Pat. Nos. 3,949,268; 3,983,449; 3,781,638; 3,078,429 and 3,005,130. In particular, U.S. Pat. No. 3,956,684 describing inverter circuits is incorporated herein by reference.

Accordingly, it is an object of the present invention to provide a transformer which is easily and inexpensively wound and which reduces energy consumption in surrounding metal structures, said transformer being particularly useful in transmitting power from push-pull square wave inverter circuits to electric discharge lamps.

DETAILED DESCRIPTION OF THE INVENTION

Figure 1:
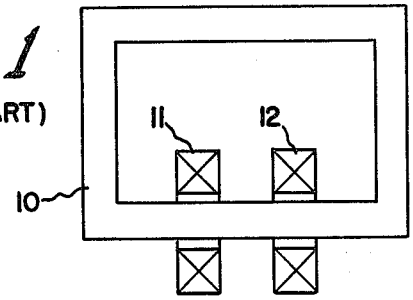
Fig. 1 (PRIOR ART)
FIG. 1 is a simplified, partial sectional elevation view of one form of prior art transformer design.

FIG. 1 illustrates a prior art transformer structure in which lumped primary winding 11 and lumped secondary winding 12 are disposed encircling a closed loop transformer core structure 10. When used in a discharge lamp ballast circuit, the necessary leakage reactance for ballasting in the transformer shown in FIG. 1 is provided by controlled relative spacing of the primary and secondary coils and the outside diameter of the lumped coils so as to increase or decrease the amount of air path magnetic flux which fails to encircle both windings.

Figure 2:
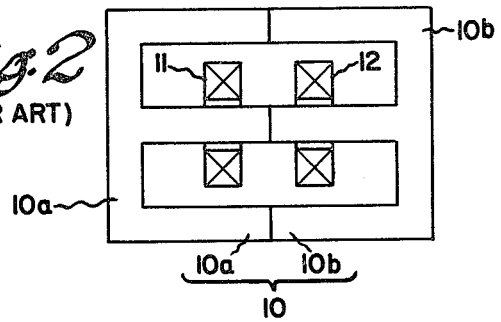
Fig. 2 (PRIOR ART)
FIG. 2 is a simplified, partial sectional elevation view illustrating another prior art transformer structure.

Likewise, FIG. 2 illustrates a prior art transformer structure in which lumped primary winding 11 and lumped secondary winding 12 encircle a central transformer core leg. In FIG. 2, the central leg is one of three legs formed by the mirror image adjacency placement of E-shaped core members 10*a* and 10*b*. However, the structure in FIG. 2 still depends upon the relative placement of windings 11 and 12 to control the amount of leakage reactance. Moreover, both the structures shown in FIG. 1 and FIG. 2 require the primary winding 11 to be wound in the time consuming and expensive bifilar pattern.

Figure 3:
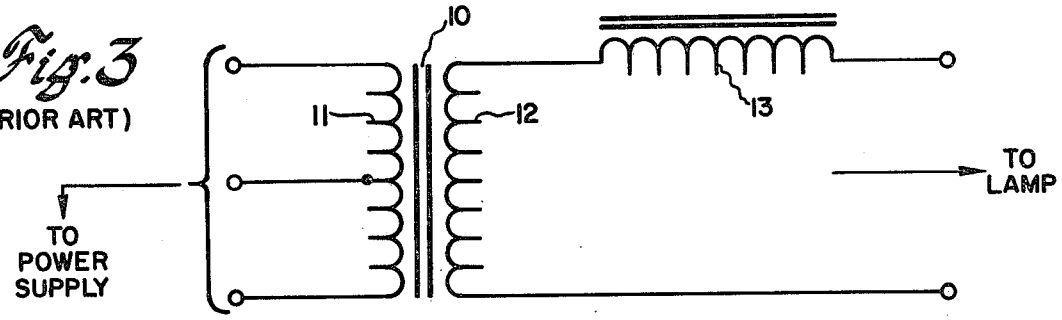
Fig. 3 (PRIOR ART)
FIG. 3 is a schematic diagram illustrating a circuit in which a separate ballasting reactance is provided.

FIG. 3 also illustrates another prior art method of providing the necessary ballasting reactance. While used, the circuit shown in FIG. 3 is a circuit of last resort because of the added cost and bulk of the separate inductance. In this circuit, there is provided in addition to a transformer with core 10, center-tapped, primary winding 11, and secondary winding 12, a separate and distinct inductor 13 with its own separate core structure.

Figure 4:
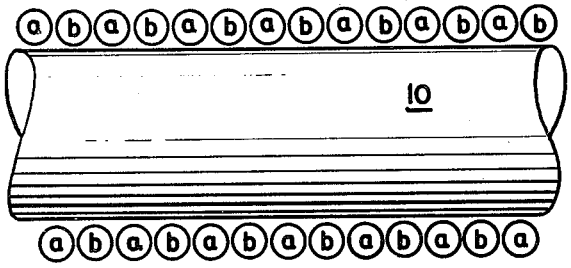
FIG. 4 is a partial sectional view illustrating the bifilar winding scheme.

FIG. 4 illustrates the configuration of the bifilar winding pattern. In FIG. 4 there are shown wound around core 10, two distinct windings a and b, in an interwoven pattern. Providing the windings in this configuration is costly, difficult, and time-consuming, particularly when related to production quantities of the windings. However, a close, uniform winding structure is required by the matching and coupling requirements of the push-pull inverter power supply.

Figure 5:
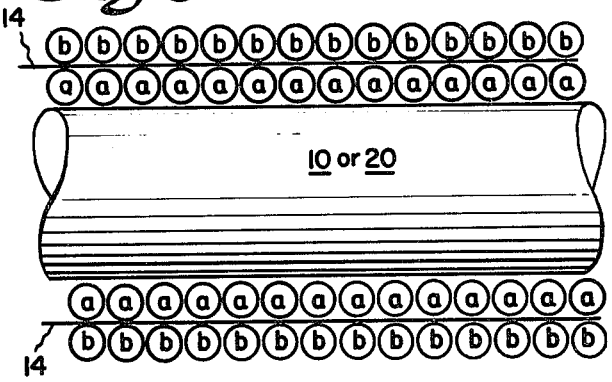
FIG. 5 is a partial sectional view illustrating an overlaid winding scheme.

FIG. 5 illustrates an overlaid winding pattern in which first windings a are disposed about the core 10 of FIGS. 1–4, or 20 or FIG. 6. After the first windings are in place, an insulating layer 14 is applied and second windings b are wound around the core in an overlaid fashion as shown. While this winding method does not provide as close a coupling as is provided by the bifilar winding process, the degree of coupling is still excellent. This winding technique is however practically limited to the situation in which only a relatively few turns of winding are required. If a large number of windings are required, the core length must be changed to accommodate the windings or the number of layers must be increased.

Many of the problems discussed above are eliminated or significantly diminished by the transformer of the present invention. In particular, in one embodiment of the present invention, the transformer core is comprised of two E-shaped core sections. Each E-shaped core section possesses outer (top and bottom) legs and a middle leg which is shorter than the two outer legs. In the core structure of the present invention, the two E-shaped core member segments are disposed in a mirror image fashion with respect to one another; that is to say, the ends of each outer leg abut with and are substantially aligned with the corresponding leg on the other core member. Due to the relative length of the middle leg members, the middle legs do not abut but rather form an air gap and together with the middle legs, provide the necessary leakage reactance for ballasting a discharge lamp. It is not to be implied however that the two E-shaped core members are necessarily identical in size. Also, while the gap as shown is centrally located to prevent induction heating in nearby metal structures, for ballasting purposes, the gap may occur anywhere in the magnetic shunt path. The windings of a transformer are located on appropriate transformer core portions. Typically, a transformer is formed by winding the coils on separate forms, removing the coils from the forms, placing them on the desired location on one of the two E-shaped transformer cores with the windings in a configuration as described above and as shown in FIG. 6. This mode of assembly is particularly facile.

While the material comprising the E-shaped core members may be of any standard material possessing a low magnetic reluctance, ferrite materials in particular possess desirable magnetic properties for the high frequency applications disclosed herein. As used herein and in the appended claims, the term "high frequency" means those frequencies substantially contained in a square wave signal operating at a repetition rate of between approximately 25 kHz and approximately 200 kHz.

For the discharge lamp application disclosed, the transformer herein need not be especially large. In particular, for powering twin 40 watt fluorescent lamps with an inverter operating at 25 kHz, a transformer size of approximately one inch by one and one-half inches is typical. With this application, frequency and approximate transformer size, the air gap provided is preferably approximately 40 mils in width. Each of the middle legs of the two E-shaped core members is 20 mils shorter than the outer legs, thereby providing an air gap 40 mils across. It is this magnetic shunt through an air gap that provides the necessary flux leakage path providing the necessary leakage ballasting reactance.

Because of the presence of the magnetic shunt, a separate ballasting reactance need not be provided. In addition, the presence of the magnetic shunt provides other significant advantages. More particularly, the presence of the magnetic shunt permits the use of a greatly reduced number of winding turns in the primary and secondary windings. This in turn permits the primary winding in particular to be wound in an overlaid fashion such as that described in FIG. 5. This overlaid winding pattern is easily insulated by a single insulation layer 14 as contrasted with the much greater insulation requirements in a bifilarly wound pattern in which there are relatively large voltage differences between easy and every turn. In the bifilar pattern, these insulation requirements mean that less space is available on the core for each winding layer. This core provides for a discharge lamp ballast circuit which may be easily manufactured in production quantities quickly and without bifilar winding. Moreover, in addition to providing an integral ballasting reactance, a centrally disposed magnetic shunt removes the leakage magnetic flux lines (between the primary and secondary windings from the vicinity of the metal casing and other surrounding metal structures and also keeps the magnetic flux substantially within the core material, thereby reducing the power consumed in these surrounding metal structures by induction heating.

Figure 6:
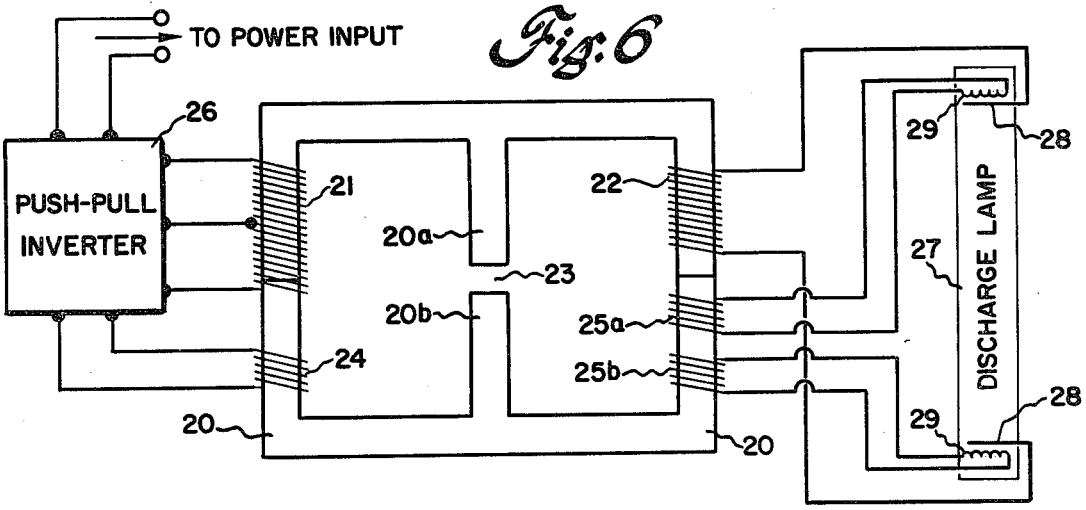
FIG. 6 is a diagrammatic view illustrating the transformer core and transformer of the present invention in use in a discharge lamp circuit.

As discussed above, transformers disclosed herein are particularly useful in discharge lamp circuits driven by power efficient push-pull inverter circuits. In particular, FIG. 6 illustrates the use of a transformer of the present invention in such a circuit. In this circuit, push-pull inverter 26 is coupled to primary winding 21 which here does not need to be wound in bifilar fashion. Also shown are optional feedback windings 24 which provide signals to the push-pull inverter 26 to control switching action of the power output portion of the inverter circuit. Power is transferred from the primary winding 21 to secondary winding 22 which is typically connected to the electrodes 28 of the discharge lamp 27. Additional filament windings 25*a* and 25*b* may be provided for the filaments 29 of the discharge lamp. As seen in FIG. 6, the transformer core 20 of the present invention is comprised of two E-shaped portions 20*a* and 20*b* disposed in a mirror image relation with one another, the middle leg of said E-shaped core members serving to form an air gap 23 which forms part of the magnetic shunt which provides the necessary ballasting reactance for the discharge lamp 27. The ballasting reactance serves to limit the current through and voltage across the discharge lamp after initiation of the discharge but does not act to impede the generation of sufficient voltage in the secondary winding to generate the discharge arc.

By way of example and not limitation, a transformer in accordance with the above description for use in powering two conventional 40 watt fluorescent lamps from line voltage is constructed as described below. The core material is advantageously composed of a ferrite such as 3C8 which is available from Ferroxcube, Inc. of Saugerties, N.Y. A primary winding comprising two portions of 32 turns each is disposed about one leg of the transformer core in an overlaid fashion similar to that shown in FIG. 5. Between each layer there is disposed a 2 mil thick layer of Mylar insulation, thereby insulating the two 32 turn primary portions from one another. A secondary winding 22 of 97 turns is disposed about another portion of the transformer core. Similarly, a two turn feedback winding 24 is provided and a one turn filament winding 25 and 25*b* is provided respectively for each filament to be powered. An inverter circuit, such as that described in U.S. Pat. No. 3,956,684 is operated in conjunction with the transformer providing a peak output current of 2.7 amperes and a peak output voltage of 336 volts. The inverter operates at a frequency of 33 kHz. While the results of the operation of the inverter, transformer, and lamp configuration are limited to the operation at the above-mentioned 33 kHz, satisfactory operation is obtained for a range of inverter frequencies between approximately 25 kHz and approximately 200 kHz.

A comparison may be made between the performance of the transformer of the present invention in the above-mentioned discharge lamp circuit and the performance of other bifilar wound transformer, particularly with those transformer structures as shown in FIGS. 1 and 2. When powering the two conventional 40 watt fluorescent lamps from line voltage through the push-pull inverter described in the preceding paragraph, the transformers of FIG. 1 and 2 each produce a power loss in the ballast case of 3.2 watts, which is 30 percent of the total ballast loss. The transformer constructed in accordance with the present invention, however, produces a power loss in the ballast case of only 1.3 watts when operated in the manner described in the preceding paragraph. In the same circuit application, transformers of the prior art design of FIGS. 1 and 2 produce an output voltage overshoot of 55 volts as compared with a voltage overshoot of 65 volts produced in the circuit in which the transformer constructed in accordance with the present invention is employed. However, this 10 volt increase in voltage overshoot is not at all detrimental to the operation of the circuit.

From the above, it may be appreciated that the transformer core and transformer structure employing the core as disclosed herein provide significant advantages over prior art transformer structures and in particular over those structures employed in discharge lamp circuits employing push-pull inverters. The invention disclosed herein permits savings in windings, winding materials, and insulation. A significant advantage is also gained in that the transformer core design of the present invention permits non-bifilar winding patterns to be employed, facilitating rapid and inexpensive assembly of the transformers disclosed herein. Moreover, the integral ballasting reactance of the present invention locates magnetic flux lines substantially in the core structure and thereby significantly reduces losses due to inductive heating.

While this invention has been described with reference to particular embodiments and examples, other modifications and variations will occur to those skilled in the art in view of the above teachings. Accordingly, it should be understood that, within the scope of the appended claims, the invention may be practiced otherwise than is specifically described.

The invention claimed is:

1. A high frequency ballasting transformer providing integral ballasting and permitting non-bifilar windings comprising:

a closed loop magnetic core of low relucatance material;

a first, single layer primary winding portion having a plurality of turns and being disposed about a first portion of said closed loop core;

a second, single layer primary winding portion having a plurality of turns and being disposed about said first primary winding and being serially connected therewith;

a secondary winding having a plurality of turns and being disposed about a second portion of said closed loop core; and a magnetic shunt with air gap therein bypassing said closed loop magnetic core, said shunt furnishing reactance in parllel with said secondary winding.

2. The transformer of claim 1 in which said first primary winding portion has substantially the same number of turns as the second primary winding portion.

3. The transformer of claim 1 in which the air gap is centrally disposed with respect to said closed loop core and with respect to said magnetic shunt.

4. The transformer of claim 1 in which the closed loop core and the magnetic shunt are formed by adjacently disposing two E-shaped members, with a middle leg shorter than two equally long outer legs, in a mirror image fashion so as the air gap is formed between said shorter middle legs.

5. The transformer of claim 1 further comprising:

at least one filament winding encircling a portion of said core.

6. The transformer of claim 1 further comprising:

an inverter feedback winding encircling a portion of said core.

7. The transformer of claim 6 further comprising:

at least one filament winding encircling a portion of said core.

8. A discharge lamp ballasting and powering circuit comprising:

the transformer of claim 7;

a push-pull square wave inverter with output means connected to said primary winding and feedback control means connected to said inverter feedback winding; and a discharge lamp with at least one filament and at least two electrodes, said filaments being connected to said filament winding and each of said electrodes being connected to opposite ends, respectively, of said secondary winding.

9. The discharge lamp circuit of claim 8 in which the square wave inverter operates at a repetition rate of between approximately 25 kilohertz and approximately 200 kilohertz.

* * * * *